US007025639B2

(12) United States Patent
Aoki et al.

(10) Patent No.: US 7,025,639 B2
(45) Date of Patent: Apr. 11, 2006

(54) PRESS-FIT PIN FOR INSERT MOLD

(75) Inventors: Wataru Aoki, Aichi (JP); Satoshi Sugimoto, Aichi (JP); Koji Hishikawa, Aichi (JP); Fusatomo Miyake, Aichi (JP); Takahiro Oshima, Aichi (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 0 days.

(21) Appl. No.: 10/464,774

(22) Filed: Jun. 19, 2003

(65) Prior Publication Data

US 2004/0157479 A1 Aug. 12, 2004

(30) Foreign Application Priority Data

Jun. 28, 2002 (JP) ..... P. 2002-190153

(51) Int. Cl.
*H01R 13/42* (2006.01)

(52) U.S. Cl. ..... 439/751; 439/78; 439/79; 439/82

(58) Field of Classification Search ..... 439/82, 439/751, 873, 80, 81, 84, 78
See application file for complete search history.

(56) References Cited

U.S. PATENT DOCUMENTS

| | | | | |
|---|---|---|---|---|
| 4,443,053 | A | 4/1984 | Astbury | |
| 4,538,878 | A * | 9/1985 | Dambach et al. | 439/742 |
| 4,735,575 | A * | 4/1988 | Shaffer | 439/82 |
| 4,857,019 | A * | 8/1989 | Brubaker et al. | 439/751 |
| 4,954,088 | A | 9/1990 | Fujizaki et al. | |
| 5,154,621 | A * | 10/1992 | Legrady | 439/82 |
| 5,462,454 | A * | 10/1995 | Kramer et al. | 439/571 |
| 5,599,213 | A * | 2/1997 | Frommer et al. | 439/857 |
| 5,928,005 | A * | 7/1999 | Li et al. | 439/82 |
| 6,098,281 | A * | 8/2000 | Rudi | 29/845 |
| 6,280,248 | B1 * | 8/2001 | Mitra | 439/571 |
| 6,325,643 | B1 * | 12/2001 | Ohtsuki et al. | 439/82 |
| 6,354,849 | B1 | 3/2002 | Jones | |
| 6,722,928 | B1 * | 4/2004 | Noda et al. | 439/751 |
| 2001/0046817 | A1 * | 11/2001 | Putnam | 439/751 |

* cited by examiner

*Primary Examiner*—Chandrika Prasad
(74) *Attorney, Agent, or Firm*—Morgan Lewis & Bockius LLP

(57) ABSTRACT

A press-fit portion (24) of a press-fit pin (22) is constructed by cutting and outwardly pushing a band-like region (24*a*), which is placed in the vicinity of the widthwise center of a pin material, in one of orientations of the thickness direction in such a way as to project from peripheral regions (24*b*) of the band-like region (24*a*). At that time, the thickness dimension (W3) of the press-fit portion (24) is set to be equal to or less than that W1 of a pin body (23).

5 Claims, 4 Drawing Sheets

PRESS-FIT PIN FOR INSERT MOLD

BACKGROUND OF THE INVENTION

The present invention relates to a press-fit pin press-fitted into a through hole of a printed circuit board and electrically connected thereto.

One of techniques for connecting an electronic component, such as IC, to a through hole of a printed circuit board having a circuit pattern is a press-fit connection technique. According to this technique, the circuit board and the electronic component can be interconnected to each other only by press-fitting an elastically bend-deformable press-fit portion of a press-fit pin into the through hole. Therefore, this technique can avoid drawbacks, such as poor connection, and thermal problems, as compared with related art soldering connection.

Thus, there has been a desire to connect a lead pin, which is used for taking a signal out of a printed circuit board, to the circuit board by performing press-fit connection. However, the lead pin is embedded in an insulator accommodating the circuit board by insert-molding in a state that opposite ends of the lead pin serving as connecting end parts to be connected to the circuit board and to an external part project from the insulator. That is, the lead pin is insert-molded in a state in which both end parts thereof are inserted and held in hole-portions provided in a molding die.

The press-fit portion is formed by snicking a plate-like pin material which constitutes the press-fit pin, and then performing a press process in such a way as to broaden the pin material in the widthwise direction thereof, so that the press-fit portion elastically deforms in the widthwise direction thereof. Therefore, the width dimension of the press-fit portion is nearly equal to that of the pin material at both end parts thereof, while that of the press-fit portion is larger than that of the pin material at the central part thereof.

Thus, in the case that the lead pin is constituted by a press-fit pin, the press-fit portion serving as a connecting end part connected to the circuit board cannot be inserted and held in the molding die. Consequently, the lead pin cannot be insert-molded.

SUMMARY OF THE INVENTION

The invention is accomplished in view of the aforementioned circumstances. Accordingly, an object of the invention is to provide a press-fit pin enabled to be insert-molded.

In order to solve the aforesaid object, the invention is characterized by having the following arrangement.

Aspect 1. A press-fit pin comprising:

a press-fit pin body; and a press-fit portion to be press-fitted into a through hole by being elastically deformed, wherein a width dimension and a thickness dimension of: the press-fit portion are set to be equal to or less than those of the press-fit pin body, respectively.

Aspect 2. The press-fit pin according to the aspect 1, wherein the press-fit portion includes:

a peripheral region, a thickness dimension of which is set to substantially half of the thickness dimension of the press-fit pin body; and a band-like region protruding from the peripheral regions, a thickness dimension of which is set to be equal to or less than the thickness dimension of the press-fit pin body.

Aspect 3. A press-fit pin comprising:

a press-fit pin body; and a press-fit portion to be press-fitted into a through hole by being elastically deformed, wherein the press-fit portion is constructed by cutting and outwardly pushing a band-like region, which is placed in vicinity of a widthwise center in the press-fit portion, in a thickness direction of the press-fit portion in such a way as to protrude from peripheral regions of the band-like region.

Aspect 4. The press-fit pin according to the aspect 3, wherein corner portions of faces at the opposite side in the widthwise direction of the band-like region are chamfered.

Aspect 5. A method of manufacturing a press-fit pin comprising the steps of:

providing a pin material including a press-fit pin body and a press-fit portion, wherein a thickness dimension of the press-fit pin body is substantially twice that of the press-fit portion;

forming a pair of grooves in a longitudinal direction of the pin material to define peripheral regions and a band-like region interposed between the peripheral regions in a width direction of the pin material; and pushing the band-like region to protrude from the peripheral regions so that a maximum thickness dimension defined by the protruding band-like region and the peripheral regions is set to be equal to or less than the thickness of the press-fit pin body.

DETAILED DESCRIPTION OF PREFERRED EMBODIMENTS

Figure 1:
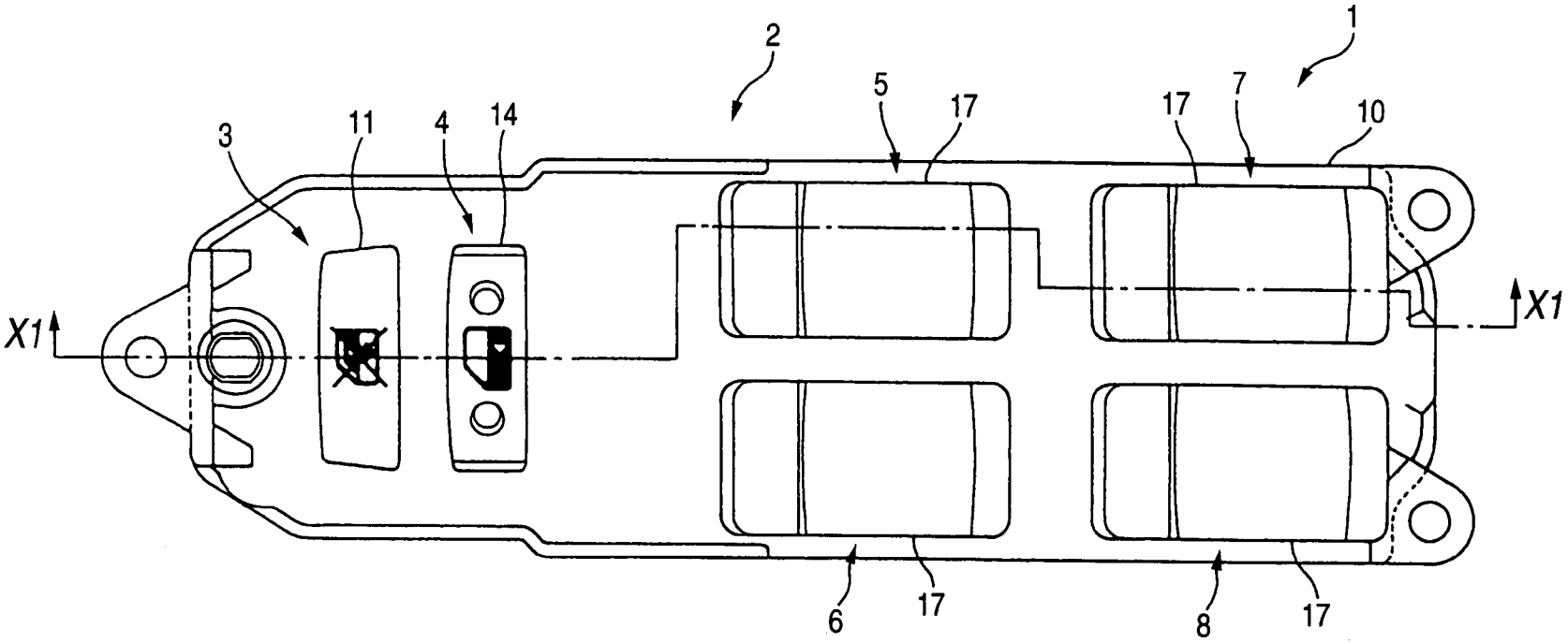
FIG. 1 shows an embodiment of the invention and is a top view illustrating a power window master switch thereof.
Figure 2:
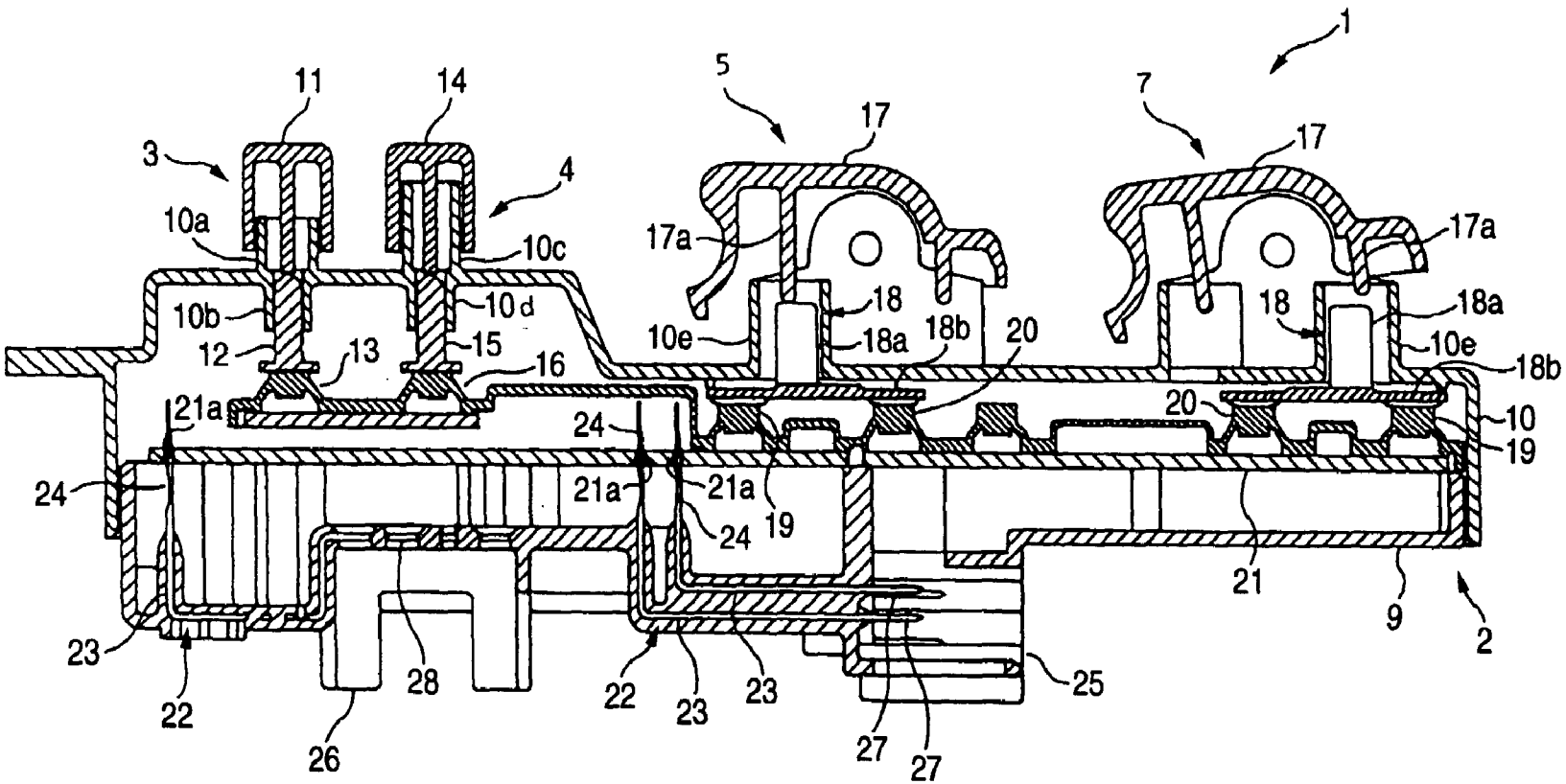
FIG. 2 is a longitudinally sectional side view taken along line X1—X1 of FIG. 1, which illustrates the power window master switch.

Hereinafter, an embodiment of the invention is described with reference to the accompanying drawings. This embodiment is obtained by applying the press-fit pin according to the invention to a vehicle power window switch. FIGS. 1 and 2 show the entire configuration of the power window switch apparatus 1. The power window switch apparatus 1 comprises an apparatus body 2, and a plurality switches 3 through 8 provided on the top surface of this apparatus body 2. The apparatus body 2 comprises a switch case 9 serving as an insulator, and a base 10 that covers the switch case 9 from above.

A switch 3 is operative to generate a signal (that is, a window lock signal) for inhibiting a window from being opened and closed. The switch 3 includes an operating knob 11 which is supported by a cylindrical portion 10*a* projected on the top surface of the base 10, and further includes a pusher 12 which is supported in a cylindrical portion 10*b* protruding from the bottom surface of the base 10, and a rubber contact 13.

A switch 4 is operative to generate a switch signal (that is, a door lock signal) for inhibiting the door from being opened and closed. The switch 4 includes an operating knob 14 supported by a cylindrical portion 10*c* projecting from the top surface of the base 10, and further includes a pusher 15, which is supported in a cylindrical portion 10*d* protruding from the bottom surface of the base 10, and a rubber contact 16.

Switches 5 to 8 are operative to generate window opening/closing switch signals. Each of the switches 5 to 8 includes an operating knob 17 pivotally provided on the top surface of the base 10, and further includes a seesaw type pusher 18 provided in the base 10 in such a way as to move in synchronization with a rocking motion of the operating knob 17. The pusher 18 includes a bar-like pressure receiving portion 18*a* which is pushed by a pushing projecting portion 17*a* of the operating knob 17, and a rocking piece portion 18*b* provided on the bottom of this pressure receiving portion 18*a* in such a manner as to be integral therewith. The pressure receiving portion 18*a* is inserted into a cylindrical portion 10*e* projecting from the top surface of the base 10. Rubber contacts 19 and 20 are provided under both the bottom parts of the rocking piece portion 18*b*.

Of the switches 5 to 8, the switch 5 is a driver's seat side window switch. The remaining switches 6 to 8 are an assistant driver's seat side window switch and backseat side window switches, respectively. Although the detail description of these switches is omitted herein, the driver's seat side window switch 5 is adapted so that the mode of operations of opening and closing the window can be changed between an automatic mode and a manual mode according to a rocking angle. The remaining switches 6 to 8 are adapted to be manually operated.

Incidentally, the drawings and descriptions of a practical configuration for control of the pushers 12 and 15, and a practical configuration for realizing rocking operations of the operating knob 17 and the pusher 18 are omitted herein, because such configurations do not relate to the gist of the invention.

On the other hand, a printed circuit board (hereunder referred to as a PC board) is disposed on the top surface of the switch case 9. The rubber contacts 13, 16, 19, and 20 are adapted to bridge between the contacts of a window regulator circuit (not shown) formed on the PC board 21 to thereby disable and enable the window regulator circuit.

Further, in the switch case 9, a plurality of press-fit pins 22 for extracting signals from the PC board 21 to an external part are insert-molded. Each of the press-fit pins 22 includes a press-fit pin body (hereunder referred to as a pin body) 23 to be embedded in the switch case 9 by insert-molding, and further includes a press-fit portion 24 provided at one of end parts of this pin body 23 in such a way as to protrude into the switch case 9. The press-fit portion 24 is press-fitted-into a through hole 21*a* provided in the PC board 21.

Terminal portions 27 and 28 exposed to the connector portions 25 and 26 provided under a lower portion of the switch case 9 are provided at the other end part of the press-fit pin 22. Between these terminal portions, the terminal portion 27 exposed to the connector portion 25 is shaped like a pin and protrudes into the connector portion 25.

Next, the configuration of the press-fit pin 22 is described with reference to FIGS. 3 to 5B with emphasis on the press-fit portion 24. The press-fit pin 22 is constructed by punching-molding of a thin plate-like pin material. A plurality of press-fit pins 22 are manufactured in such a manner as to be connected to one another through connecting portions (not shown). After the insert-molding, the connecting portions are cut off to thereby electrically insulate the press-fit pins 22 from one another.

In the case of this embodiment, the width dimensions of the pin bodies 23 and the press-fit portions 24 are set to be nearly equal to each other. Further, apart of the pin materials in which each of the pin body 23 is formed has a thickness dimension W1 that is about twice that W2 of a part in which the press-fit portion 24 is formed.

The press-fit portion 24 is formed by cutting and outwardly pushing the band-like region 24*a*, which is placed in the vicinity of the widthwise center of the press-fit portion 24, in the thickness direction in such a way as to project from peripheral regions 24*b* of the band-like region 24*a*. Incidentally, the peripheral regions 24*b* are slightly elastically deformed owing to the cutting and pushing of the band-like region 24*a*. At that time, the band-like region 24*a* is cut and pushed by a thickness dimension thereof at the maximum. Thus, the thickness dimension (that is, the maximum thickness dimension) W3 of a most outwardly pushed-out part 24*c* of the band-like region 24*a* of the press-fit portion 24 is about twice that W2 of the press-fit portion 24. Consequently, the maximum thickness dimension W3 of the press-fit portion 24 is equal to or less than that W1 of a pin body 23.

Figure 5A:
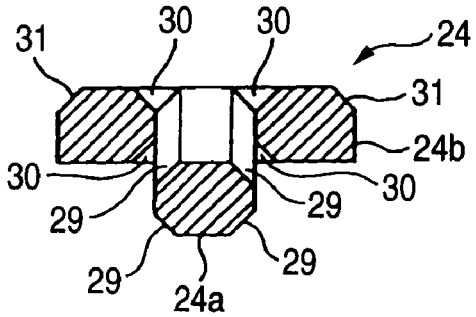
FIG. 5A is a transversely sectional view taken along line X2—X2 of FIG. 3.
Figure 5B:
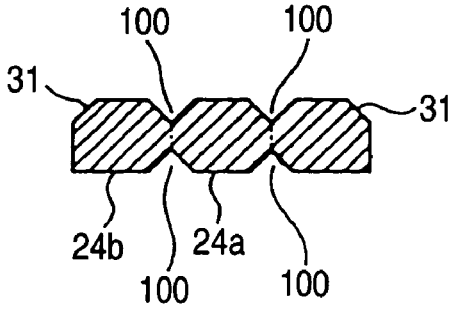
FIG. 5B is a transversally sectional view illustrating the pin material of a press-fit portion, which is in a state held before a band-like region is cut and pressed outwardly.

Further, before the band-like region 24*a* is pushed outwardly, as shown in FIG. 5B, two groove portions 100 each having a triangular section are provided at the boundary portions between the band-like region 24*a* and one of the peripheral regions 24*b* and between the region 24*a* and the other peripheral region 24*b* on both sides in the widthwise direction of the pin material, from which the press-fit portion 24 is formed. Then, the press-fitted portion 24 is formed by outwardly pushing the band-like region 24*a* along the groove portions 100.

Consequently, as illustrated in FIG. 5A, the corner portions of both faces in the thickness direction of the band-like region 24*a* are chamfered, so that inclined faces 29 are formed. Thus, the most outwardly pushed-out part 24*c* of the band-like region 24*a* is separated from the peripheral regions 24*b*.

Figure 3:
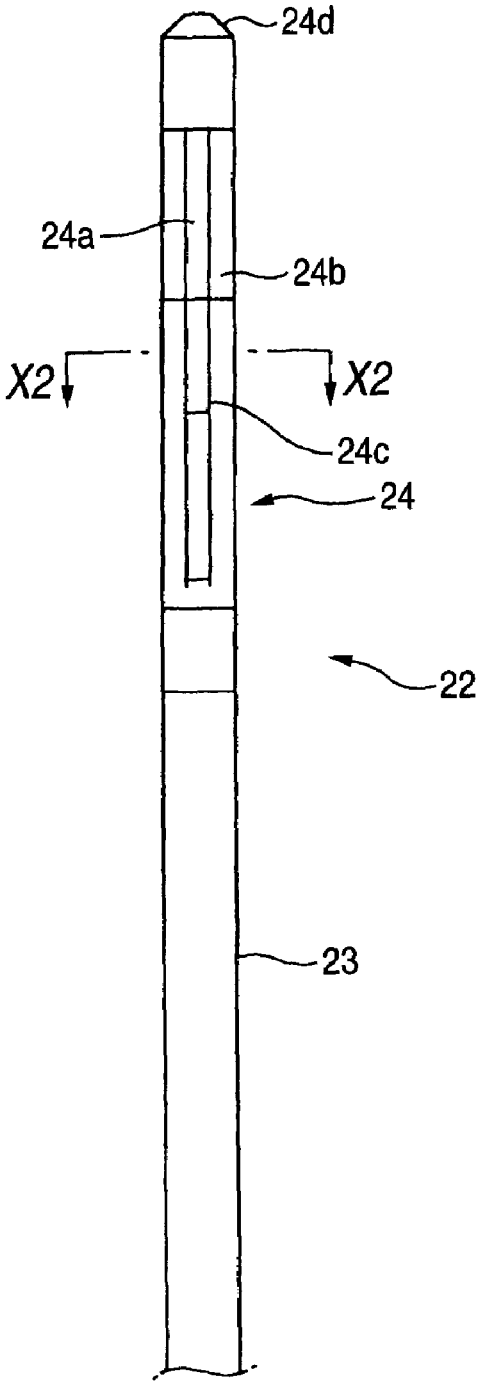
FIG. 3 is a front view illustrating a press-fit pin.
Figure 4:
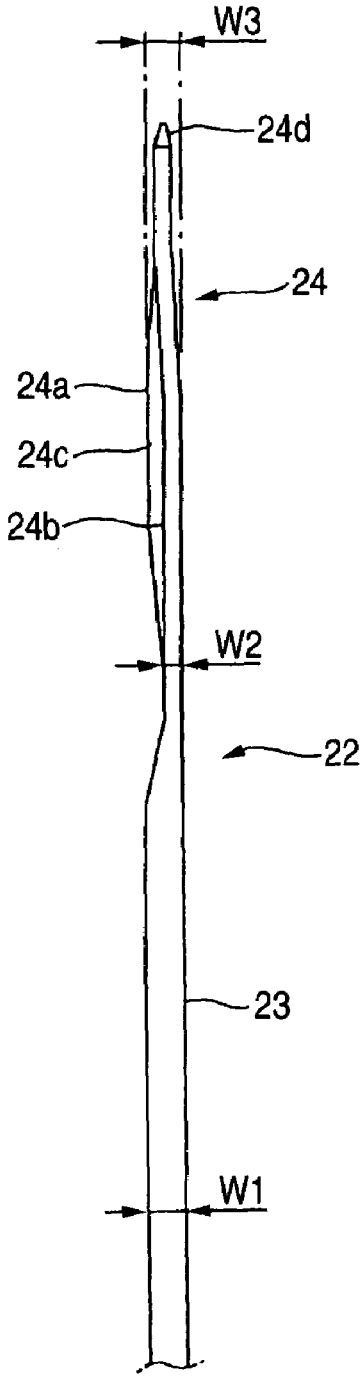
FIG. 4 is a side view illustrating the press-fit pin.

Incidentally, as illustrated in FIGS. 5A and 5B, inclined faces 30 are formed at the side of the peripheral regions 24*b* by outwardly pushing the band-like region 24*a* along the groove portions 100. Further, inclined faces 31 are formed at the corner portions of the faces at the other side in the widthwise direction of the peripheral regions 24*b* by being chamfered so that the press-fit portion 24 can be smoothly inserted into the through hole. Furthermore, as shown in FIGS. 3 and 4, a tip end part 24*b* of the press-fit-portion 24 is constructed in such a way as to be tapered off so that the press-fit portion 24 can smoothly be inserted into the through hole.

Figure 6:
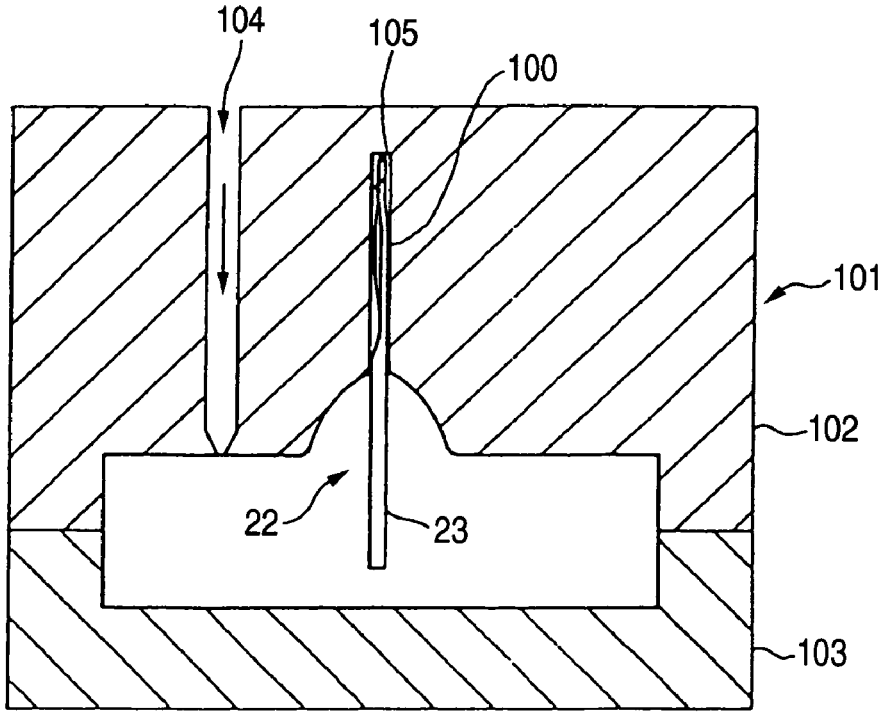
FIG. 6 is a view schematically illustrating a molding die for a switch case.

Meanwhile, FIG. 6 is a schematic view illustrating a molding die used for embedding the press-fit pin 22 into the switch case 9 by insert-molding. The molding die 101 includes an upper die 102 and a lower die 103. The upper die 102 is provided with a gate 104 from which molten insulating resin (hereunder referred to as molten resin) is poured, and an insertion hole portion 105 through which the press-fit pin 22 is inserted.

The insertion hole portion 105 is formed like a cylindrical hole whose shape corresponds to that of a section of the pin body 23 of the press-fit pin 22. Therefore, the press-fit pin 22 inserted into the insertion hole portion 105 from the side of the press-fit portion 24 is held by fitting a part of the pin body 23 into the insertion hole portion 105.

At that time, most of the pin bodies 23 of the press fit pins 22 protrude into a space between the upper die 102 and the lower die 103. Then, molten resin is injected thereinto from the gate 104 and hardened, so that the switch case 9 is formed in such a way as to be in a state in which the press-fit pin 22 is embedded in a predetermined part.

Thus, this embodiment is configured so that the maximum thickness dimension W3 of the press-fit portion 24 is equal to or less than the thickness dimension W1 of the pin body 23. Consequently, the press-fit pin 22 can be inserted into and held in the molding die 101. Hence, the press-fit pin 22 can be embedded in the switch case 9 by insert-molding.

Further, the press-fit portion 24 is constructed by cutting and outwardly pushing the band-like region 24*a* in the thickness direction in such a way as to protrude from the peripheral regions 24*b*. Consequently, the contact pressure obtained by press-fitting the press-fit portion 24 into the through hole 21*a* can be set to be relatively high. Electrical connection between the press-fit pin 22 and the PC board 21 can be favorably maintained.

Furthermore, because the inclined surfaces 29 and 30 are formed by chamfering the corner portions of the band-like region 24*a* and the peripheral regions 24*b*, the band-like region 24*a* and the peripheral region 24*b* can sufficiently be separated from each other by outwardly pushing the band-like region 24*a* from the peripheral regions 24*b* by a thickness dimension of this band-like region 24*a*. Therefore, the dimension of the pushed-out band-like region 24*a*, which is needed for obtaining a sufficient contact pressure against the through hole 21*a* of the press-fit portion 24 can be restricted to a small value. Furthermore, the thickness dimension of the press-fit portion 24 can be reduced.

Moreover, the inclined faces 29 and 30 are provided on the corner portions on both sides in the thickness direction of the band-like region 24*a* and the peripheral regions 24*b*. Thus, the contact portions between the band-like region 24*a* and one of the peripheral regions 24*b* and between the band-like region 24*a* and the other peripheral region 24*b* during the insertion of the press-fit portion 24 into the through hole 21*a* can be reduced. Consequently, favorable contact load can be obtained.

Further, in this embodiment, the groove portions 100 are formed in both side surfaces of the pin material before the band-like region 24*a* is cut and pushed outwardly. Then, the band-like region 24*a* is cut and outwardly pushed along the groove portions 100. Thus, the inclined faces 29 and 30 can easily be formed on the band-like region 24*a* and the peripheral regions 24*b*.

Incidentally, the invention is not limited to the aforementioned embodiment. Appropriate modifications and expansions can be made. For example, the press-fit pin can be used by being embedded in a package of electronic components, such as ICs.

As is apparent from the foregoing description, according to the press-fit pin of the invention, the width dimension and the thickness dimension of the press-fit portion are set to be equal to or less than those of a press-fit pin body, respectively. Thus, when the press-fit pin body is embedded in the insulator by insert-molding, the press-fit portion can be inserted into and held in the molding die.

Further, the press-fit pin of the invention is configured so that the press-fit portion is constructed by cutting and outwardly pushing a band-like region, which is placed in the vicinity of the widthwise center in the press-fit portion, in one of orientations of the thickness direction thereof in such a manner as to project from the peripheral regions of the band-like region. Thus, the contact pressure against the through hole of the press-fit portion can be set to be relatively high.

What is claimed is:

1. A press-fit pin comprising:

a press-fit pin body; and a press-fit portion to be press-fitted into a through hole by being elastically deformed, the press-fit portion including a band-like region disposed between adjacent peripheral regions, the band-like region protruding from the peripheral regions in a thickness direction of the press-fit portion, wherein the opposite sides of the band-like region are separated from the peripheral regions in the thickness direction and opposite ends of the band-like region are connected to the peripheral regions in the axial direction, and wherein a width dimension and the thickness dimension of the press-fit portion are set to be equal to or less than a width dimension and a thickness dimension of the press-fit pin body, respectively.

2. The press-fit pin according to claim 1, wherein the peripheral region has a thickness dimension of substantially half of the thickness dimension of the press-fit pin body; and the band-like region protruding from the peripheral region has a thickness dimension equal to or less than the thickness dimension of the press-fit pin body.

3. A press-fit pin comprising:

a press-fit pin body; and a press-fit portion to be press-fitted into a through hole by being elastically deformed, wherein the press-fit portion is constructed by cutting and outwardly pushing a band-like region, which is placed in vicinity of a widthwise center in the press-fit portion, in a thickness direction of the press-fit portion in such a way as to protrude from peripheral regions of the band-like region, and wherein the opposite sides of the band-like region are separated from the peripheral regions in the thickness direction and opposite ends of the band-like region are connected to the peripheral regions in the axial direction, and wherein a width dimension and a thickness dimension of the press-fit portion are set to be equal to or less than a width dimension and a thickness dimension of the press-fit pin body, respectively.

4. The press-fit pin according to claim 3, wherein corner portions of faces at the opposite side in the widthwise direction of the band-like region are chamfered.

5. A method of manufacturing a press-fit pin comprising the steps of:

providing a pin material including a press-fit pin body and a press-fit portion, wherein a thickness dimension of the press-fit pin body is substantially twice a thickness dimension of the press-fit portion;

forming a pair of grooves in a longitudinal direction of the pin material to define peripheral regions and a band-like region interposed between the peripheral regions in a width direction of the pin material, wherein the opposite sides of the band-like region are separated from the peripheral regions in the thickness dimension and opposite ends of the band-like region are connected to the peripheral regions in the longitudinal direction, and pushing the band-like region to protrude from the peripheral regions so that a maximum thickness dimension defined by the protruding band-like region and the peripheral regions is set to be equal to or less than the thickness of the press-fit pin body.

* * * * *